US006386475B1

(12) United States Patent
Mima et al.

(10) Patent No.: US 6,386,475 B1
(45) Date of Patent: May 14, 2002

(54) AUTOMATIC WINDER

(75) Inventors: Hiroshi Mima, Jouyou; Yoichi Nakamura, Kyoto, both of (JP)

(73) Assignee: Murata Kikai Kubushiki Kaisha, Kyoto (JP)

( * ) Notice: Subject to any disclaimer, the term of this patent is extended or adjusted under 35 U.S.C. 154(b) by 0 days.

(21) Appl. No.: 09/664,738

(22) Filed: Sep. 19, 2000

(30) Foreign Application Priority Data

Sep. 21, 1999 (JP) ..... 11-266436

(51) Int. Cl.[7] ..... B65H 54/22
(52) U.S. Cl. ..... 242/474.1; 242/475.9
(58) Field of Search ..... 242/474, 474.1, 242/474.2, 475.9

(56) References Cited

U.S. PATENT DOCUMENTS

| | | | | | |
|---|---|---|---|---|---|
| 4,576,340 | A | * | 3/1986 | Aretz et al. | 242/475.9 |
| 4,634,066 | A | * | 1/1987 | Matsui et al. | 242/474.1 |
| 4,742,967 | A | * | 5/1988 | Sanno et al. | 242/474.1 |
| 4,844,358 | A | * | 7/1989 | Kamp | 242/474 X |
| 5,137,222 | A | * | 8/1992 | Katada | 242/474.2 |
| 5,184,305 | A | * | 2/1993 | Gronenberg | 242/474 X |
| 5,323,979 | A | * | 6/1994 | Grecksch et al. | 242/474.1 |
| 5,328,110 | A | * | 7/1994 | Wirtz et al. | 242/470 |
| 5,374,000 | A | * | 12/1994 | Matsui et al. | 242/474.1 |

FOREIGN PATENT DOCUMENTS

| | | |
|---|---|---|
| JP | 09-100067 | 4/1997 |

* cited by examiner

*Primary Examiner*—Michael R. Mansen
(74) *Attorney, Agent, or Firm*—Armstrong, Westerman & Hattori, LLP

(57) ABSTRACT

An automatic winder that enables the number of yarn-supplying-bobbin feeding devices to be increased easily. In an automatic winder comprising an ejection passage 2 formed therein for ejecting a bobbin conveying medium (a tray T) with a bobbin placed thereon and a feeding passage formed therein for supplying the bobbin conveying medium, the automatic winder having a plurality of installation spaces S in each of which a single winding unit U can be installed, wherein a yarn-supplying-bobbin feeding device 12 that is compatible with the winding unit U in terms with mounting dimensions is installed in an arbitrary installation space S while the winding unit U is installed in each of the other installation spaces S so that the bobbin conveying medium ejected from the winding unit U can be received by the yarn-supplying-bobbin feeding device 12 via the ejection passage 2 while the bobbin conveying medium can be supplied from the yarn-supplying-bobbin feeding device 12 to the winding unit U via the feeding passage 3. The number of yarn-supplying-bobbin feeding devices 12 can be increased easily, so that for example, the number of yarn types handled by a single automatic winder can be changed easily.

4 Claims, 10 Drawing Sheets

AUTOMATIC WINDER

FIELD OF THE INVENTION

The present invention relates to improvements of an automatic winder comprising winding units for rewinding a yarn from a yarn supplying bobbin into a package.

BACKGROUND OF THE INVENTION

Conventionally, magazine type automatic winders and tray type automatic winders are known. The magazine type automatic winder comprises magazines for each winding unit which each stock bobbins therein so that an operator supplies bobbins to each magazine, via which the bobbins are supplied to each winding unit. In contrast, the tray type automatic winder has been developed to save required labor.

An automatic winder 1 based on the tray type conventionally comprises a plurality of winding units U arranged on a base, and a main body controller MMC and a yarn-supplying-bobbin automatic feeding device CBF disposed at a left and right ends of the group of winding units, respectively, as in the example shown in FIG. 10, and also comprises an ejection passage 2 formed on a front (work passage side) ejection conveyor and a feeding passage 3 formed on a rear feeding conveyor, the ejection passage 2 and the feeding passage 3 being formed in the front and rear of the automatic winder, respectively, as shown in FIG. 9. The yarn-supplying-bobbin automatic feeding device CBF of the automatic winder 1 supplies a yarn supplying bobbin B installed on each tray (a bobbin conveying medium) to each winding unit U via the feeding passage 3. The winding unit U rewinds a yarn from the yarn supplying bobbin B, and an empty bobbin B' is collected in the yarn-supplying-bobbin automatic feeding device CBF via the ejection passage 2. The yarn-supplying-bobbin automatic feeding device CBF pulls the empty bobbin B' out from the tray T and then installs a yarn supplying bobbin B on the tray T.

Since the automatic winder 1 has the only one yarn-supplying-bobbin automatic feeding device CBF, for example, it cannot easily produce many types of packages each in a small amount. Major changes are required to increase the number of yarn-supplying-bobbin automatic feeding devices CBF in order to produce many types of packages.

It is thus an object of the present invention to solve these problems by providing an automatic winder that allows the number of yarn-supplying-bobbin feeding devices to be increased easily.

SUMMARY OF THE INVENTION

Means employed by the present invention in order to allow the number of yarn-supplying-bobbin feeding devices to be increased easily is an automatic winder comprising an ejection passage formed therein for ejecting a bobbin conveying medium with a bobbin placed thereon and a feeding passage formed therein for feeding the bobbin conveying medium, the automatic winder having a plurality of installation spaces in each of which a single winding unit can be installed, the winder being characterized in that a yarn-supplying-bobbin feeding device that is compatible with the. winding unit in terms with mounting dimensions is installed in an arbitrary installation space while the winding unit is installed in each of the other installation spaces so that the bobbin conveying medium ejected from the winding unit can be received by the yarn-supplying-bobbin feeding device via the ejection passage while the bobbin conveying medium can be fed from the yarn-supplying-bobbin feeding device to the winding unit via the feeding passage. That is, the present invention is an automatic winder comprising a plurality of winding units and an arbitrary number of yarn-supplying-bobbin feeding devices, wherein the winding unit is compatible with the yarn-supplying-bobbin feeding device in terms of mounting dimensions so that the yarn-supplying-bobbin feeding device can be installed where an arbitrary winding unit has been removed or the winding unit can be installed where the yarn-supplying-bobbin feeding device has been removed.

According to the present invention, the yarn-supplying-bobbin feeding device that is compatible with the winding unit in terms of mounting dimensions is installed in an arbitrary installation space in which the winding unit is otherwise installed, thereby allowing the number of yarn-supplying-bobbin feeding devices to be increased so that the yarn-supplying-bobbin feeding devices, the number of which has been increased, can receive and feed the bobbin conveying media from and to the winding units. The yarn-supplying-bobbin feeding device supplies a new yarn supplying bobbin to the bobbin conveying medium, and a bobbin removing device is required for removing, from the bobbin conveying medium received by the yarn-supplying-bobbin feeding device, at least a bobbin that is inappropriate to be fed to the winding unit, for example, an empty bobbin or a bobbin with a very small amount of yarn remaining thereon. The bobbin removing device is preferably provided in the yarn-supplying-bobbin feeding device but may be provided at another arbitrary position that enables the object to be met.

Means employed by the present invention in order to allow the yarn-supplying-bobbin feeding device to mutually separate the plurality of winding units is the automatic winder wherein the yarn-supplying-bobbin feeding device comprises a cut-off member for cutting off each of the ejection passage and the feeding passage and a linking passage for connecting a downstream end of the cut-off ejection passage and an upstream end of the cut-off feeding passage together.

According to the present invention, the bobbin conveying medium is circled through the group of individual separated winding units without moving out from the group, thereby preventing, for example, different types of yarns from being wound by a single winding unit.

Means employed by the present invention in order to facilitate installation of a bobbin removing device is the automatic winder wherein the yarn-supplying-bobbin feeding device comprises a bobbin removing device for removing the bobbin from the bobbin conveying medium ejected from the winding unit.

According to the present invention, the yarn-supplying-bobbin feeding device and the bobbin removing device can be simultaneously installed. The bobbin removing device may remove all bobbins from the bobbin conveying media irrespective of the amount of yarn remaining on the bobbin or may remove only empty bobbins or bobbins with a very small amount of yarn remaining thereon using bobbin remaining amount detecting means for detecting the amount of yarn remaining on the bobbin. In the latter case, means is required for precluding a new yarn supplying bobbin from being supplied to a bobbin conveying medium which the bobbin has not been removed.

Means employed by the present invention in order to simplify the feed of yarn supplying bobbins as well as the yarn-supplying-bobbin feeding device is the automatic winder wherein the yarn-supplying-bobbin feeding device comprises a magazine in which a plurality of yarn supplying bobbins can be stored, a yarn end holder for holding yarn ends of the yarn supplying bobbins stored in the magazine, a yarn supplying bobbin picker for picking up the yarn supplying bobbins from the magazine one at a time, a yarn supplying bobbin guide for dropping the yarn supplying bobbin picked up from the magazine, onto the linking passage in such a manner that the yarn supplying bobbin stands perpendicularly, and a yarn cutter disposed between a position at which the yarn supplying bobbin is dropped and the yarn end holder.

According to the present invention, the yarn supplying bobbins can be stored in the magazine with the yarn ends of the bobbins held by the yarn end holder, and the yarn supplying bobbin picked up from the magazine by the yarn supplying bobbin picker can be guided and dropped onto the linking passage by the yarn supplying bobbin guide in such a manner that the yarn supplying bobbin stands perpendicularly. The yarn supplying bobbin, standing perpendicularly, can be installed on the bobbin conveying medium resting where the yarn supplying bobbin has fallen, and the yarn of the dropped yarn supplying bobbin can be cut by the yarn cutter to form a new yarn end that is separated from the yarn end holder. That is, the compact configuration can be used to install the yarn supplying bobbin on the bobbin conveying medium and to find the yarn end of the yarn supplying bobbin.

DETAILED DESCRIPTION OF THE PREFERRED EMBODIMENTS

An automatic winder according to the present invention will be described below based on the embodiment shown in FIGS. 1 to 8.

Figure 1:
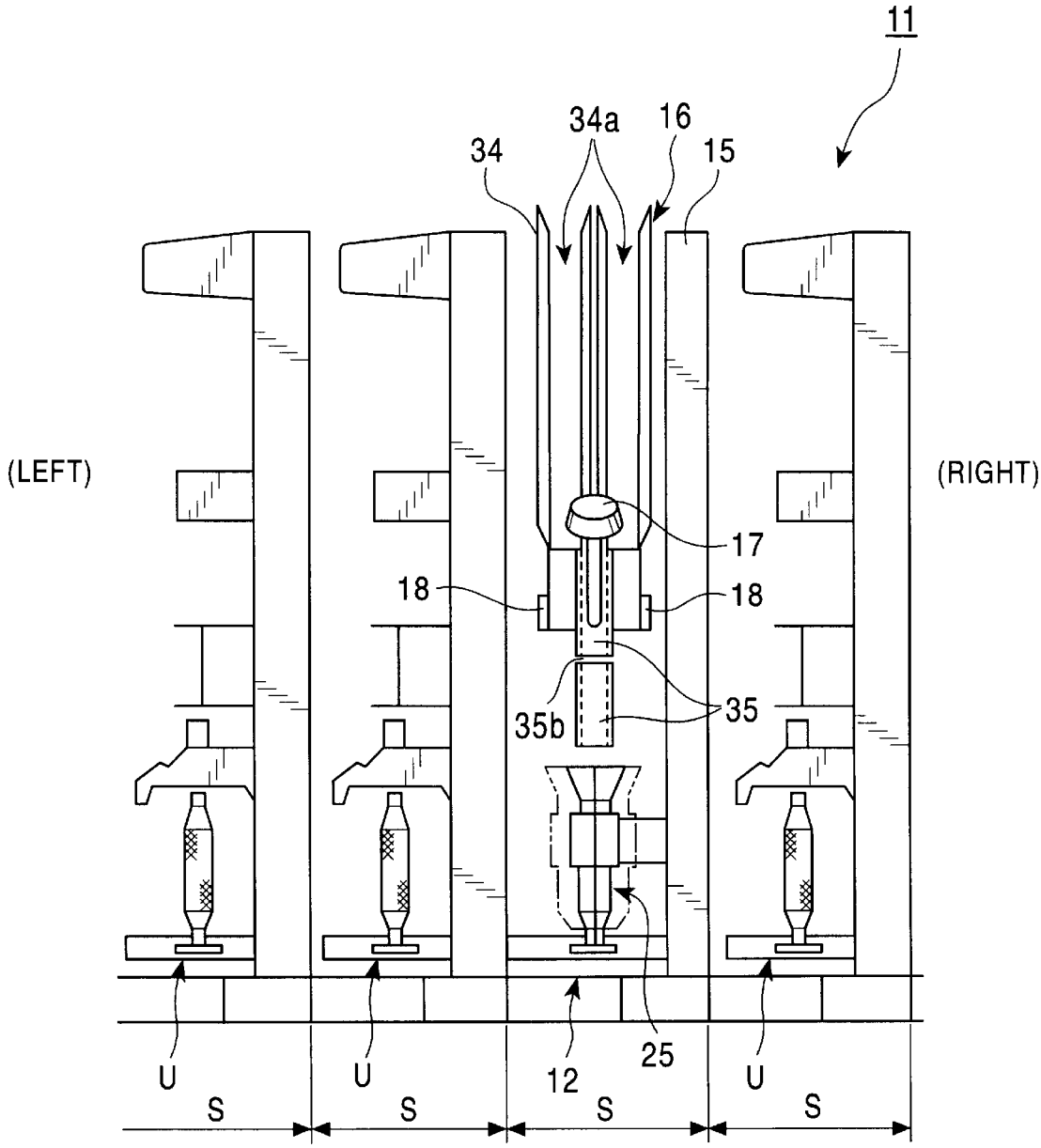
FIG. 1 is a front view of an embodiment of an automatic winder according to the present invention, showing a neighborhood of a position where a yarn-supplying-bobbin feeding device is installed which is compatible with a winding unit in terms of mounting dimensions.
Figure 2:
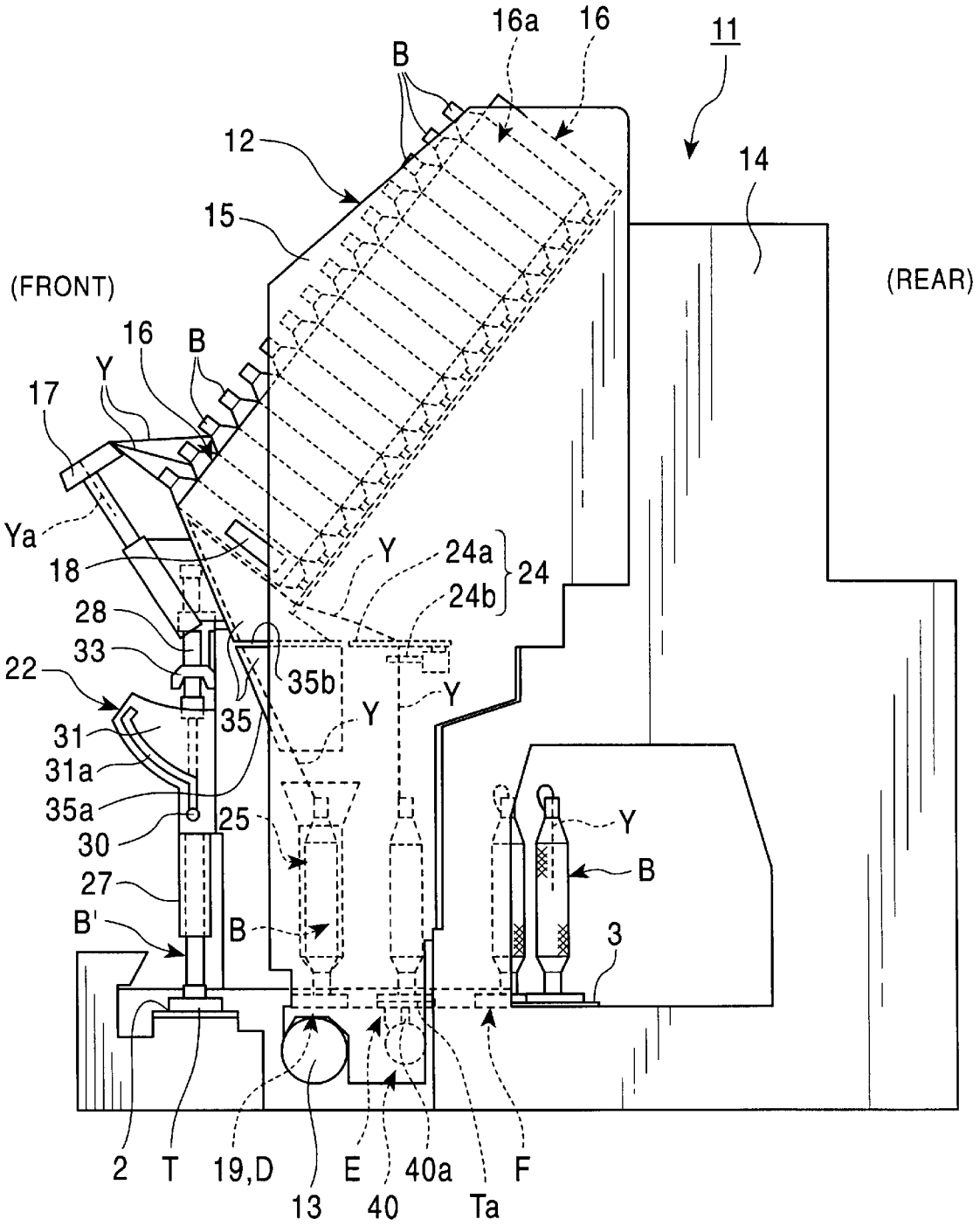
FIG. 2 is a right side view of the yarn-supplying-bobbin feeding device according to this embodiment.
Figure 3:
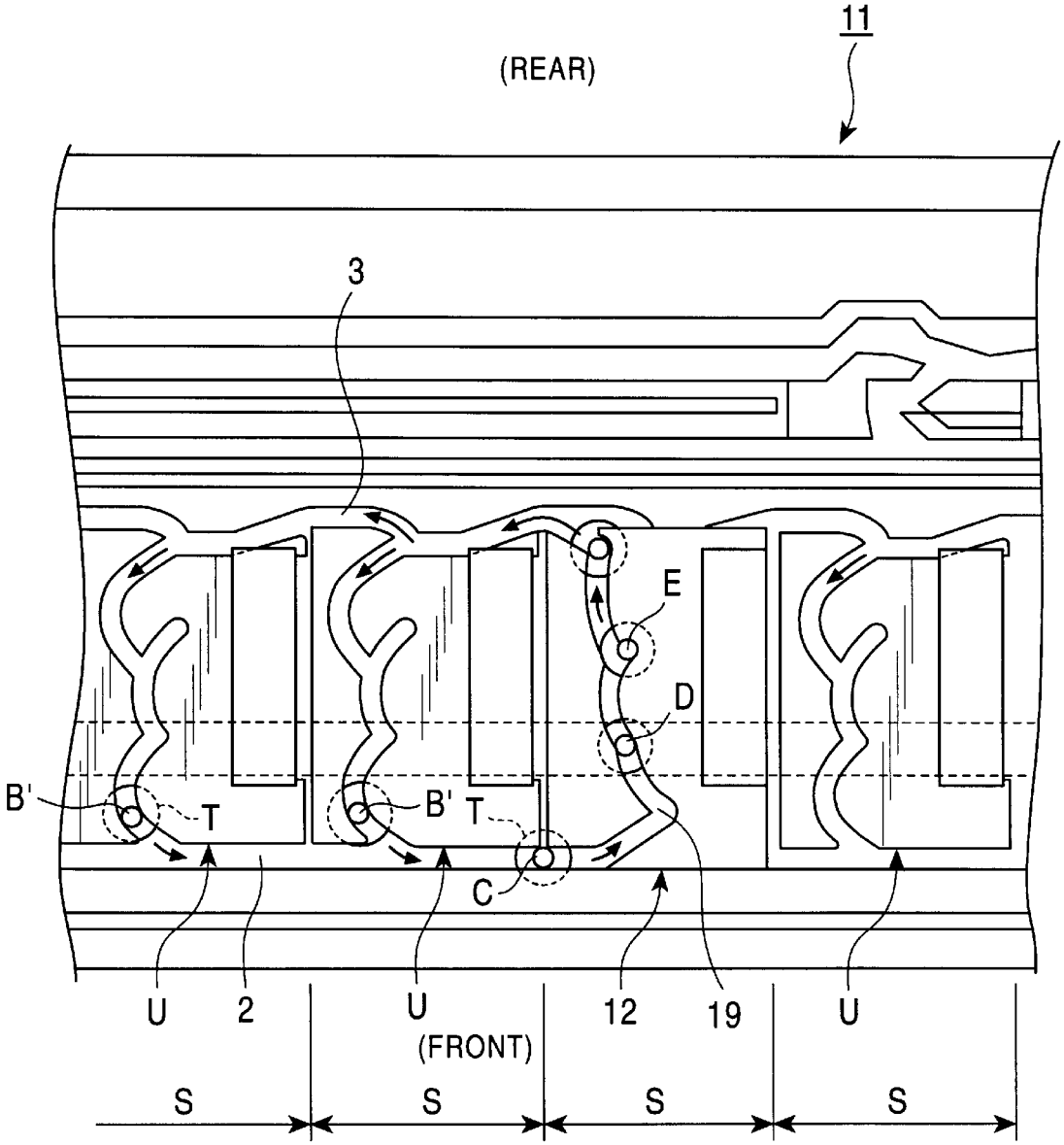
FIG. 3 is a top view showing a section between an ejection passage and a feeding passage according to this embodiment.

As shown in FIGS. 1 to 3, an automatic winder 11 according to this embodiment comprises a plurality of installation spaces S formed between a front ejection passage 2 having an ejecting conveyor to eject a bobbin conveying medium and a rear feeding passage 3 having a feeding conveyor to feed the bobbin conveying medium, wherein a single winding unit U can be installed in each of the installation spaces S. A yarn-supplying-bobbin feeding device 12 that is compatible with the winding unit U in terms of mounting dimensions is installed in an arbitrary installation space S, with the other installation spaces C each having the winding unit U. The single yarn-supplying-bobbin feeding device 12 is installed for the single winding unit or the plurality of winding units U arranged in parallel so as to handle the one particular winding unit U or the plurality of winding units U. A tray T that is a bobbin conveying medium ejected from the one particular winding unit U or the plurality of winding units U is or/are received by the yarn-supplying-bobbin feeding device 12 via the ejection passage 2 and then fed from the yarn-supplying-bobbin feeding device 12 to the one particular winding unit U or the plurality of winding units U via the feeding passage 3. The number of winding units U assigned to the single yarn-supplying-bobbin feeding device 12 is determined as appropriate based on a production plan determined depending on the type of a yarn, production, and the like. Although omitted from FIGS. 1 and 3, the yarn-supplying-bobbin feeding device 12 is also provided in the right of the drawings so that, for example, V-type yarn supplying bobbins are handled at the left side of the illustrated yarn-supplying-bobbin feeding device 12 whereas W-type yarn supplying bobbins are handled at the left side thereof. A plurality of yarn-supplying-bobbin feeding device 12 may be provided for the plurality of winding units.

Figure 4:
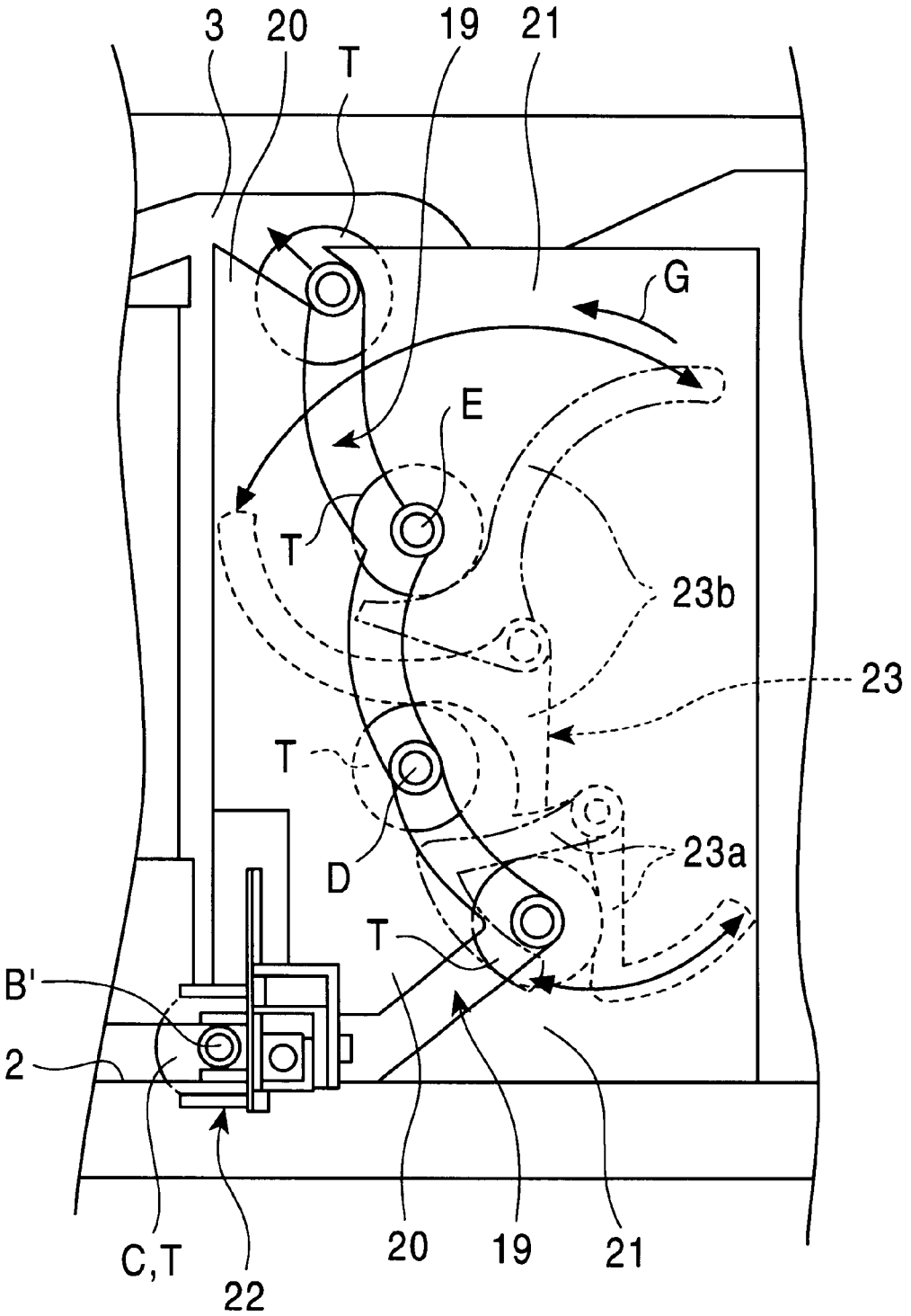
FIG. 4 is a top view showing a linking passage for the yarn-supplying-bobbin feeding device formed between the ejection passage and the feeding passage as well as a tray feeding device according to this embodiment.

As shown in FIGS. 3 and 4, the yarn-supplying-bobbin feeding device 12 has the front ejection passage 2 and the rear feeding passage 3 each installed in a fashion being cut off at the device 12 and has a linking passage 19 formed between passage forming plates 20 and 21 to connect a downstream end of the cut-off ejection passage 2 and an upstream end of the cut-off feeding passage 3 together. The front ejection passage 2 and the rear feeding passage 3 are cut off by the passage forming plates 20 and 21 provided in the yarn-supplying-bobbin feeding device 12. That is, the passage forming plates 20 and 21 constitute members forming the linking passage 19 and cutting off the ejection passage 2 and the feeding passage 3. The linking passage 19 has a tray delivery mechanism 23 comprising a large oscillating lever 23*a* and a small oscillating lever 23*b* to intermittently deliver trays T transferred on the ejection passage 2 to the feeding passage 3. The passage forming plates 20 and 21 may not cut off the ejection passage 2 or the feeding passage 3.

As shown in FIGS. 3 and 4, the tray T supporting a bobbin B' (normally an empty bobbin without a yarn but sometimes a bobbin with a very small amount of yarn remaining thereon or with a relatively large amount of yarn remaining thereon) ejected from the winding unit U is transferred on the ejection passage 2 and stopped at a bobbin receiving position C by means of a bobbin removing device 22, which will be described later. The tray T from which the bobbin B' has been removed is pushed to an upstream side of the linking passage 19 through the ejection passage 2. Then, the oscillating lever 23*a* of the tray delivery mechanism 23 oscillates to deliver the tray T to a yarn-supplying-bobbin installing position D, where the tray T is halted. While the tray T is at a halt, a yarn supplying bobbin B is installed on the tray T, the yarn supplying bobbin B being guided and dropped by a yarn supplying bobbin guide 25 (see FIG. 6), described later, in such a manner that the yarn supplying bobbin B stands perpendicularly. The tray T with the yarn supplying bobbin B installed thereon is then delivered to a yarn cutting position E when the oscillating lever 23*b* of the tray delivery mechanism 23 oscillates. While the tray T is halted at the yarn cutting position E, a yarn held by a yarn end holder 17, described later, is cut by a yarn cutter 24 (see FIG. 5), described later, while the end of the cut yarn on the yarn supplying bobbin B is sucked and inserted into a hollow portion of the bobbin to make the yarn end of the yarn supplying bobbin B available. The tray T is then pushed to the feeding passage 3 by means of the oscillating lever 23*b*, which is oscillating in an arrow G direction.

As shown in FIGS. 1 and 2, the yarn-supplying-bobbin feeding device 12 comprises a frame 15 removably located on and fixed to a support pipe 13 and a fixing frame 14, a bobbin removing device 22 for removing the bobbin B', a magazine 16 in which a plurality of yarn supplying bobbins B can be stored, a yarn end holder 17 for holding yarn ends Ya of the yarn supplying bobbins B stored in the magazine 16, yarn supplying bobbin pickers 18, 18 for picking up the yarn supplying bobbins B from the magazine 16 one at a time, a yarn supplying bobbin guide 25 for dropping the yarn supplying bobbin B picked up from the magazine 16, onto the linking passage 19 in such a manner that the yarn supplying bobbin B stands perpendicularly, and a yarn cutter 24 disposed between a position where the yarn supplying bobbin B is dropped and the yarn end holder 17. The bobbin removing device 22, the magazine 16, the yarn end holder 17, the yarn supplying guide 25, and the yarn cutter 24 are mounted and arranged on the frame 15. The yarn supplying bobbin pickers 18, 18 are integrated with the magazine 16.

Figure 6:
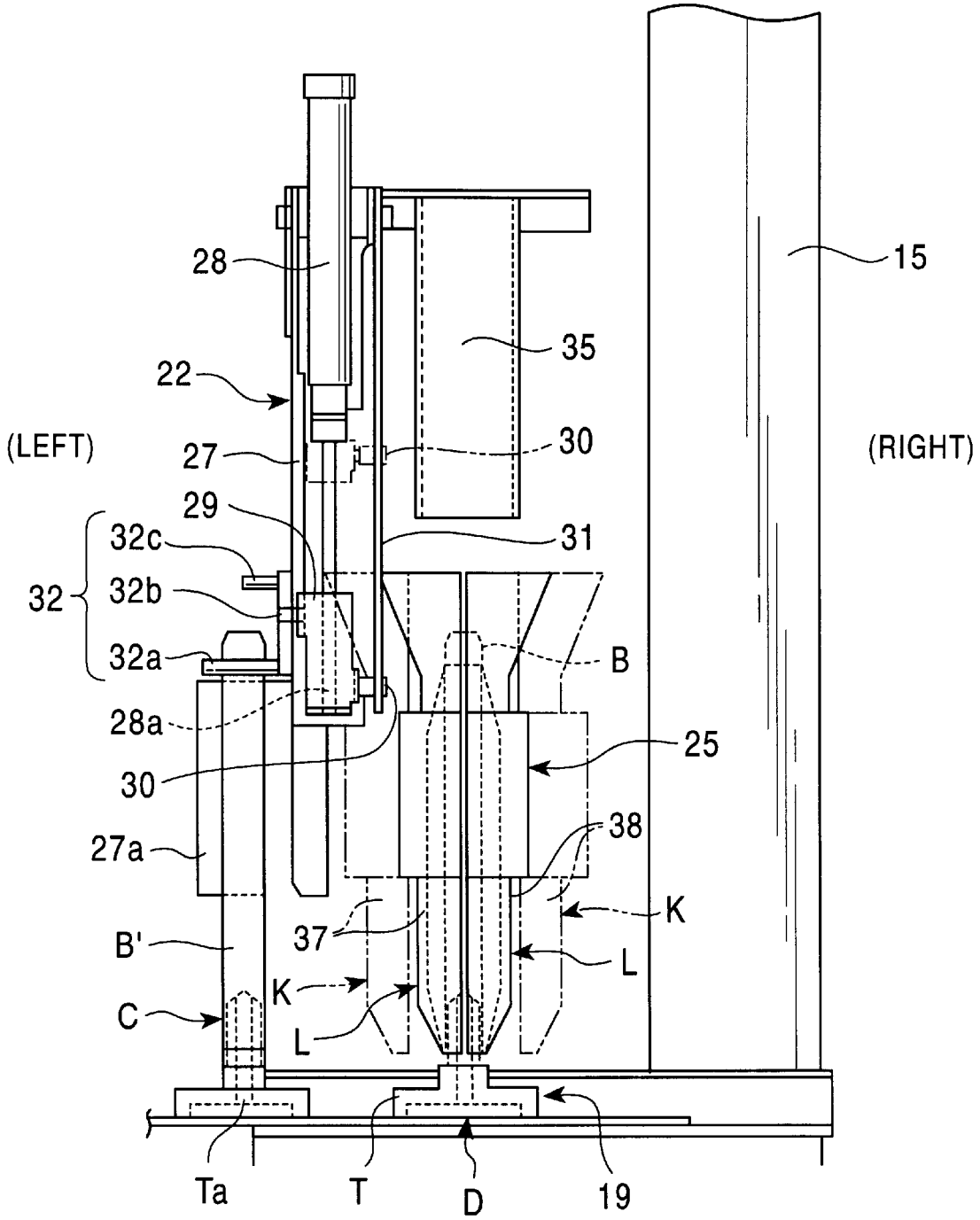
FIG. 6 is a top view showing the yarn supplying bobbin guide and a bobbin removing device provided in the yarn-supplying-bobbin feeding device according to this embodiment.
Figure 7:
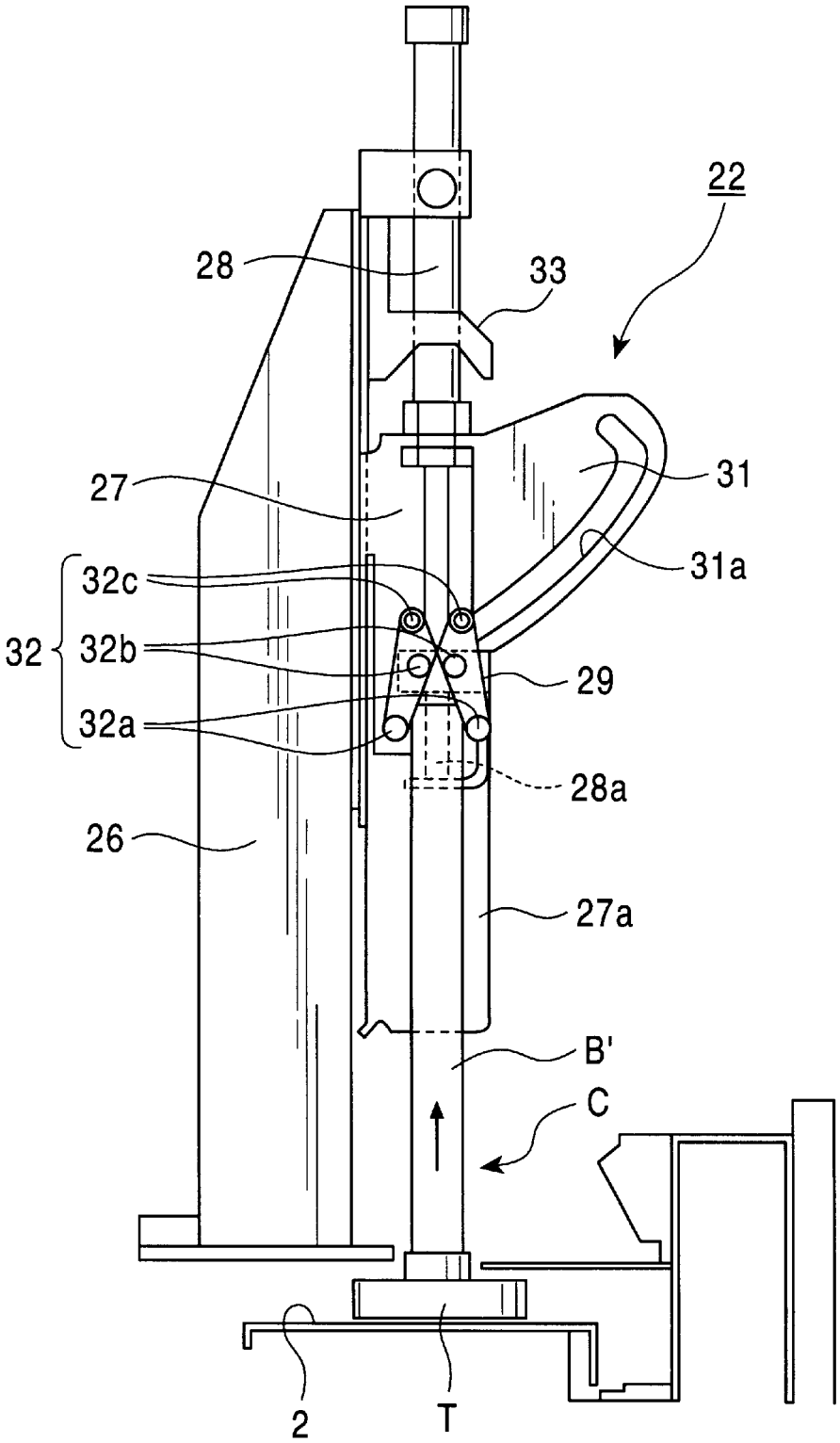
FIG. 7 is a left side view showing that the bobbin removing device is receiving an empty bobbin installed on a tray by gripping its head according to this embodiment.

As shown in FIG. 2 and FIGS. 6 to 8, the bobbin removing device 22 comprises an operating member 28 comprising an oscillating piece 27 concentrically journaled to a supporting stand 26 for oscillation, an air cylinder, and other components, a sliding piece 29 slidably guided by the oscillating piece 27 to move upward or downward and having an output end 28*a* of the operating member 28 joined thereto, a fixed guiding piece 31 forming a groove 31*a* through which a pin 30 (see FIGS. 2 and 6) projected from the sliding piece 29 is guided, the fixed guiding piece 31 being fixedly joined to the supporting stand 26, a gripper 32 for journaling 32*b*, 32*b*, to the sliding piece 29, two gripping sections 32*a*, 32*a* urged in a direction in which a head of the bobbin B' is gripped, and a gripping clearer 33 coming in abutment with the other ends 32*c*, 32*c* of the gripping sections 32*a*, 32*a* of the gripper 32 that has been raised to an upper stop position, to clear the gripping state of the gripping sections 32*a*, 32*a* against the urging force. The oscillating piece 27 is located on the ejection passage 2 so as to come in contact with the bobbin B' on the tray T conveyed on the ejection passage 2. The groove 31*a* in the fixed guiding piece 31 for guiding the pin 30 of the sliding piece 29 is shaped so that the gripper 32 and the oscillating piece 27 stand perpendicularly when the gripper 32 and the sliding piece 29 are standing by in a lower part as shown in FIG. 7, and are inclined forward when the gripper 32 and the sliding piece 29 are rising toward a stop position located above, as sown in FIG. 8. The sliding piece 27 has a guiding section 27*a* formed therein and through which the pulled-out bobbin B' is ejected and guided.

Figure 8:
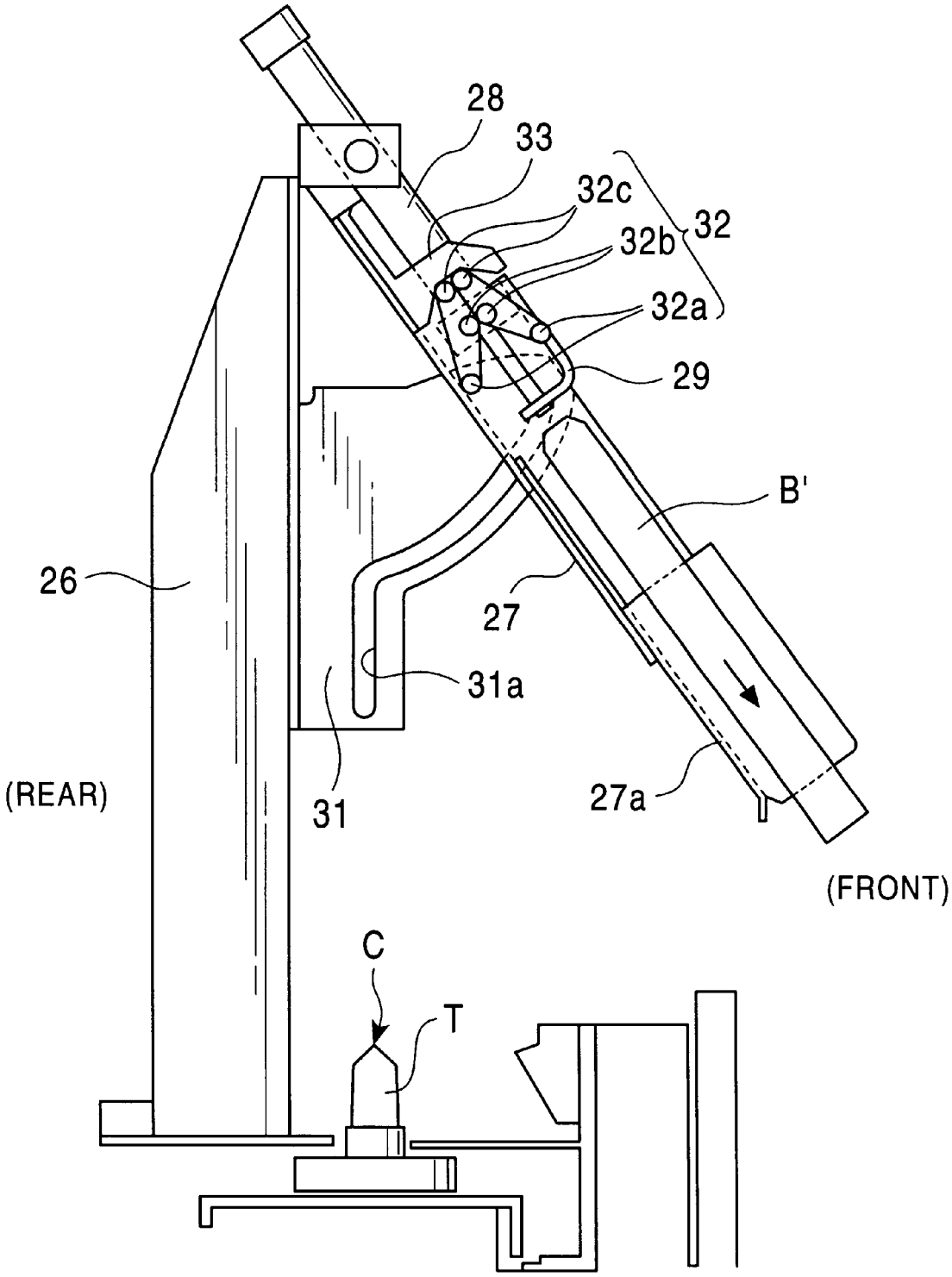
FIG. 8 is a left side view showing that the empty bobbin pulled out from the tray is being ejected according to this embodiment.

As shown in FIGS. 4 and 7, when the bobbin B' on the tray T, guided by the ejection passage 2, comes in contact with the oscillating piece 27 and stops at the bobbin receiving position C, the operating member 28 of the bobbin removing device 22 presses the standing-by gripper 32 downward and the gripping sections 32*a*, 32*a* of the gripper 32 of the bobbin removing device 22 grip the head of the bobbin B'. Then, the operating member 28 of the bobbin removing device 22 raises the gripper 32 and the sliding piece 29 to the stop position located above to forcibly remove the bobbin B' from the tray T and then oscillate the oscillating piece forward, as shown in FIG. 7. Finally, as shown in FIG. 8, when the gripper 32 and the sliding piece 29 reach the stop position located above, the gripping sections 32*a*, 32*a* of the gripper 32 of the bobbin removing device 22, which comes in contact with the gripping clearer 33, clear the gripping state to release the bobbin B'. The released bobbin B' slides through the inclined guiding section 27*a* and is collected in a bobbin collecting cart (not shown in the drawings) located in front of the winding unit U in advance.

As shown in FIGS. 1 and 2, the magazine 16 comprises a storage main body 34 forming storage sections 34*a*, 34*a* shaped like inclined grooves in which a plurality of yarn supplying bobbins B are stored in two lateral rows, an ejection guide 35 disposed between the right and left storage sections 34*a*, 34*a* so as to communicate with ejection ports (not shown in the drawings) each opened in an inner side of the storage section 34*a* close to a lower end thereof, and the right and left yarn supplying bobbin pickers 18, 18 comprising oscillating levers or the like to push the bottom one of the group of yarn supplying bobbins B to the ejection port in the storage section 34*a* to pick up the yarn supplying bobbin B, the yarn supplying bobbins B being stored in each storage section 34*a* in a fashion being stacked up. The storage main body 34 may comprise only the storage section 34*a* to store the yarn supplying bobbins B in one row. The ejection guide 35 includes an inclined guide plate 35*a* in the front thereof, has its lower end and rear side opened, and has a gap 35*b* formed therein to divide the guide 35 into an upper and lower portions. A yarn handling lever 24*a* of the yarn cutter 24 oscillates and passes through the gap 35*b*. When the yarn supplying bobbin B is stored in the storage main body 34 of the magazine 16, the yarn end Ya of the yarn supplying bobbin B is held by the yarn end holder 17. The yarn supplying bobbin B is manually stored, but may be automatically stored by an automatic feeding device (not shown in the drawings) provided in the magazine 16.

As shown in FIGS. 1, 2, 5, and 6, the yarn supplying bobbin guide 25 disposed below the magazine 16 comprises a support section 36 (see FIG. 5) joined to the frame 15, divided sections 37, 38 journaled to the supporting section 36 for horizontal oscillation, and an operating member (not shown in the drawings), so that the operating member moves the divided sections 37, 38 forward or backward between a receding position K (see FIGS. 5 and 6) where the divided sections are mutually separated and a forward position L where the divided sections are mutually close. The divided sections 37, 38, when mutually close, form a funnel-shaped guide section in an upper part thereof while forming a cylindrical guide section in a lower part thereof, to drop the yarn supplying bobbin B ejected from the ejection guide 35 of the magazine 16, onto the linking passage 19 in such a manner that the yarn supplying bobbin B stands perpendicularly. The yarn supplying bobbin B is installed on the tray T stopped at the yarn-supplying-bobbin installing position D of the linking passage 19. To move the yarn supplying bobbin B installed on the tray T as well as the tray T from the yarn-supplying-bobbin installing position D to the yarn cutting position E (see FIG. 4), the divided sections 37, 38 are mutually separated to prevent the moving yarn supplying bobbin B from coming in contact with the divided sections 37, 38.

Figure 5:
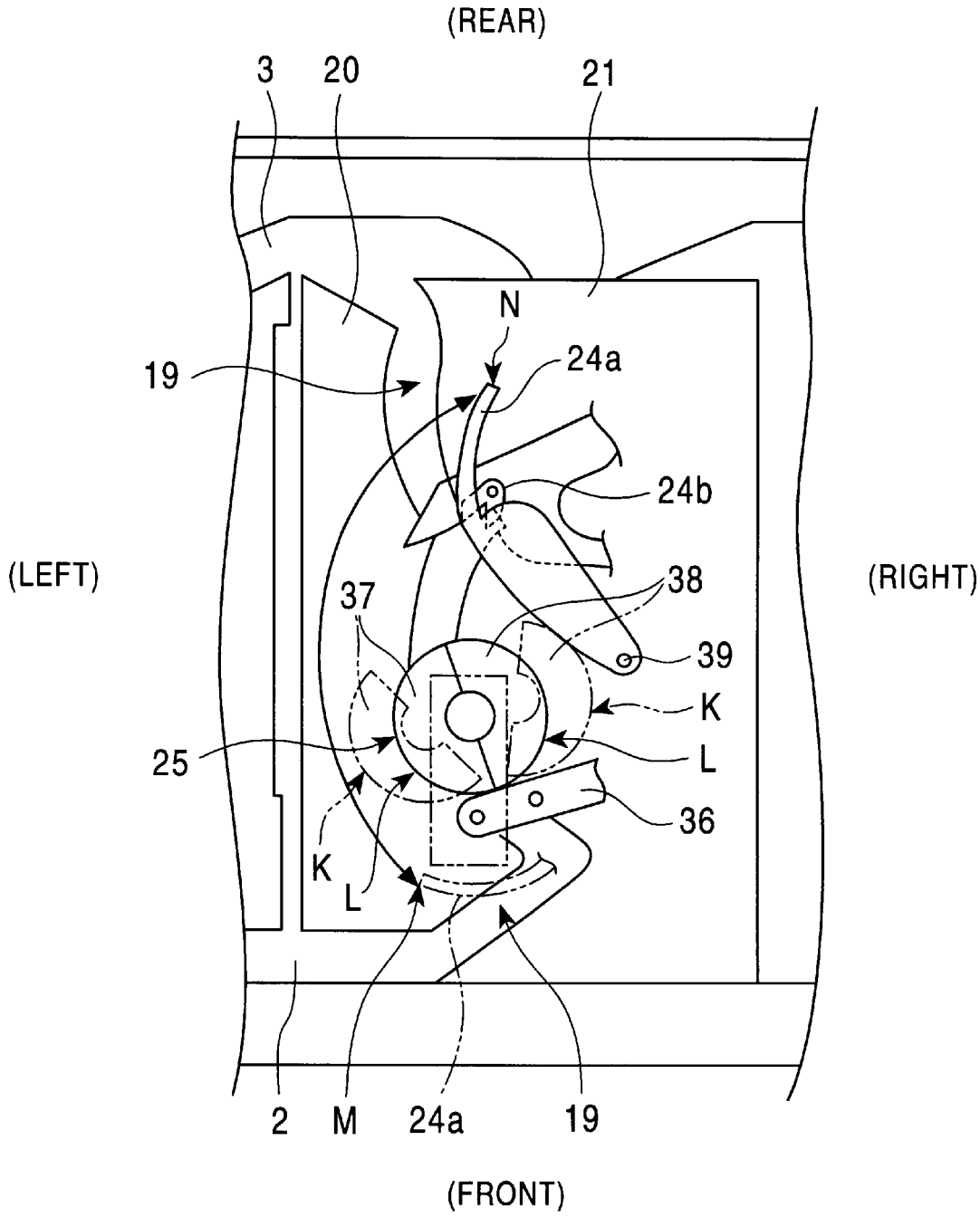
FIG. 5 is a top view showing a yarn supplying bobbin guide and a yarn cutter provided in the yarn-supplying-bobbin feeding device according to this embodiment.

As shown in FIGS. 2 and 5, the yarn cutter 24 comprises a yarn handling lever 24*a* journaled 39 for horizontal oscillation so as to pass through the gap in the ejection guide 35, an operating member (not shown in the drawings) comprising a cam mechanism, an air cylinder, or the like to operate the yarn handling lever 24*a*, and a cutter 24*b*, wherein the operating member moves the yarn handling lever 24*a* from a receding position M to an advancing position N where the yarn is cut. After the yarn supplying bobbin B installed on the tray T has moved from the yarn-supplying-bobbin installing position D to the yarn cutting position E, the yarn cutter 24 oscillates the yarn handling lever 24*a* from the receding position M to the advancing position N so that the yarn Y leading from the yarn supplying bobbin B stopped at the yarn cutting position E to the yarn end holder 17 extends in a substantially vertical direction. After this yarn handling, the cutter 24 cuts the yarn Y.

As shown in FIG. 2, the linking passage 19 has a suction port 40*a* in a suction device 40 opened at the yarn cutting position E so that a suction port Ta in the tray T stopped at the yarn cutting position E is in communication with the suction port 40*a* in the suction device 40. When the suction port Ta in the tray T is sucked and set at a negative pressure, the yarn supplying bobbin B installed on the tray T has its hollow portion sucked and set at a negative pressure, so that the yarn end Y on the yarn supplying bobbin which has been obtained by the cutter 24*b* is sucked into the hollow portion of the bobbin.

Figure 9:
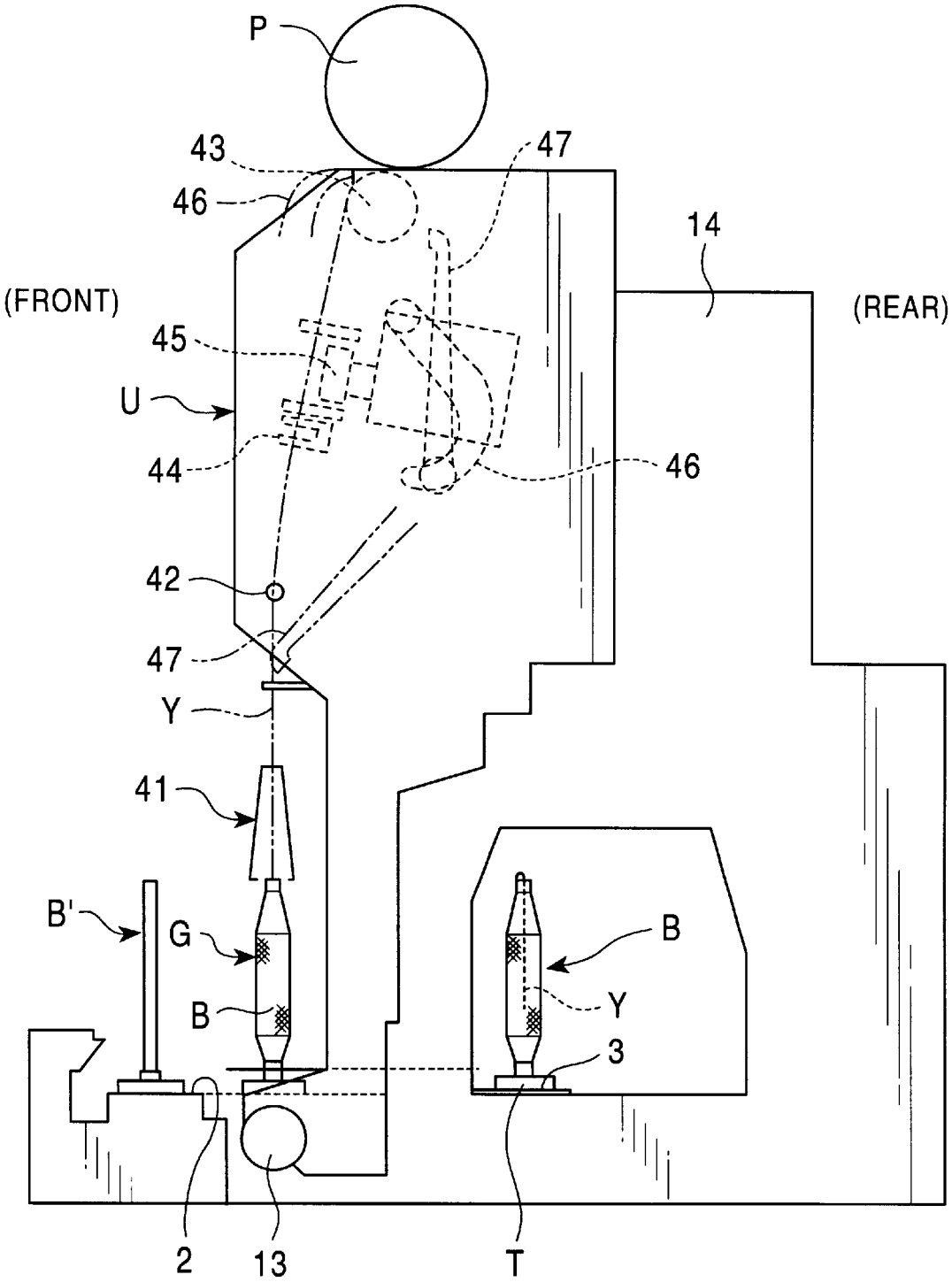
FIG. 9 is a right side view showing a winding unit.
Figure 10:
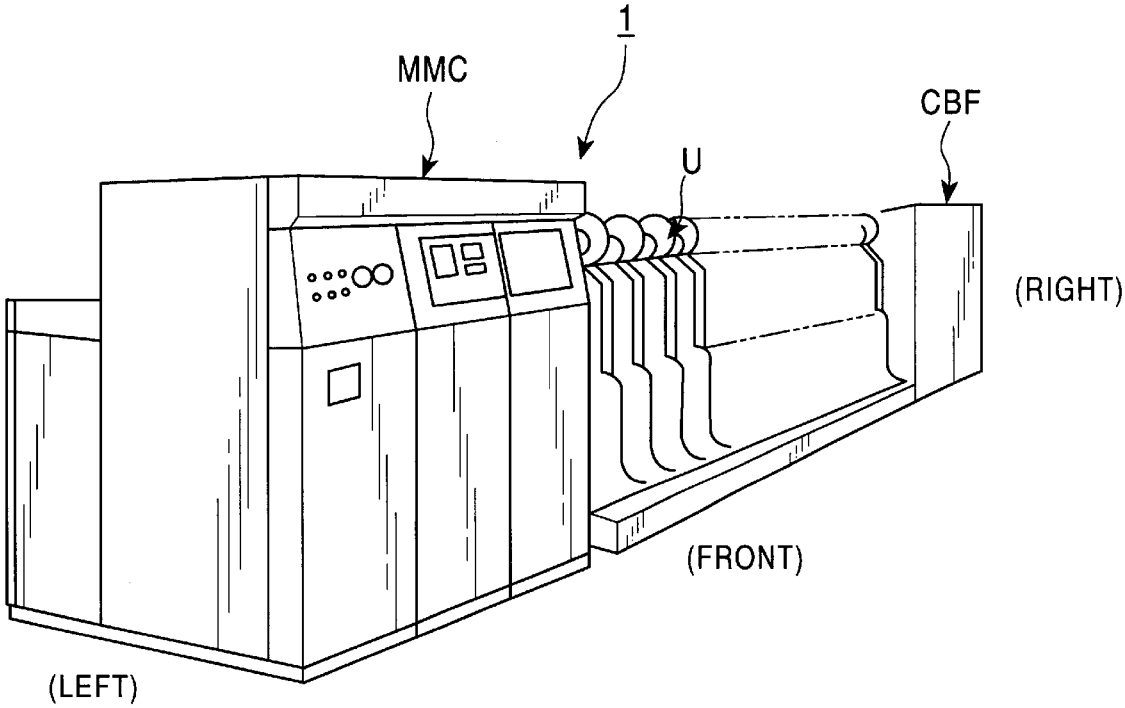
FIG. 10 PRIOR ART
FIG. 10 is a perspective view showing a conventional automatic winder.

As shown in FIG. 9, the winding unit U is removably located on and fixed to the support pipe 13 and the fixing frame 14, the yarn unwound from the yarn supplying bobbin B positioned and fed at an unwinding position is wound into a winding package P rotated by a traversing drum 43 after passing through a balloon breaker 41, a disc or a gated tenser 42 for applying a predetermined tension, a slub catcher 44 for detecting a defective portion of the yarn, and other components. 45 is a splicing device, 46 is a suction mouth for guiding an upper yarn on the package side to the splicing device 45, and 47 is a relay pipe for guiding a lower yarn on the yarn supplying bobbin side to the splicing device 45. The yarn supplying bobbin B still installed on the tray is laterally moved via the feeding passage 3 and a feeding device (not shown in the drawings) such as an inclined disc or a conveying belt and fed to an unwinding position G of the winding unit U. After unwinding, the tray T with the unwound bobbin B' thereon is ejected to the ejection passage 2, and a tray T with a new yarn supplying bobbin B thereon is supplied instead. The yarn Y of the yarn supplying bobbin B newly supplied to the unwinding position is blown up and sucked into the relay pipe 47.

Next, the operation of the automatic winder 11 according to this embodiment will be explained.

In the yarn-supplying-bobbin feeding device 12, the yarn supplying bobbins B having their yarn ends Ya held by the yarn end holder 17 are stored in the storage sections 34*a*, 34*a* of the magazine 16 so as to be stacked up, as shown in FIG. 2. As shown in FIG. 3, the tray T ejected from the winding unit U and supporting the bobbin B' is ejected to the ejection passage 2 and then conveyed to the yarn-supplying-bobbin feeding device 12. The tray T conveyed on the ejection passage 2 is halted when the bobbin B' comes in abutment with the oscillating piece 27 (see FIG. 7) at the bobbin receiving position C, as shown in FIG. 4. The bobbin B' supported on the stopped tray T is gripped by the gripping sections 32*a*, 32*a* of the lowering gripper 32 of the bobbin removing device 22 and is then pulled out from the tray T by the subsequently elevating gripper 32, as shown in FIG. 7. The pulled-out bobbin B' is inclined forward with the further rising gripper 32, subsequently released from the gripper 32, which is cleared at the upper stop position, then guided by a guide section 27*a*, and then collected in the bobbin collecting cart (not shown in the drawings), as shown in FIG. 8. According to this embodiment, all the bobbins B' on the trays T ejected from the winding units U are removed by the bobbin removing device 22 regardless of the amount of yarn remaining, but a bobbin remaining-yarn-amount detecting means may be provided to selectively remove only empty bobbins or bobbins with a small amount of yarn remaining thereon.

As shown in FIG. 4, the tray T from which the bobbin B' has been pulled out is guided to an inlet of the linking passage 19 formed in the yarn-supplying-bobbin feeding device 12 and then delivered to the yarn-supplying-bobbin installing position D by the oscillating lever 23*a* of the tray delivery mechanism 23, where the tray T is then halted. Once it has been confirmed that the tray T is stopped at the yarn-supplying-bobbin installing position D, the yarn supplying bobbin picker 18 of the yarn-supplying-bobbin feeding device 12 shown in FIG. 2 is actuated to pick up one of the yarn supplying bobbins B stored in the magazine 16 and place it in the ejection guide 35. The picked-up yarn supplying bobbin B slides on the inclined guide plate 35*a* of the ejection guide 35 and falls through an internal space of the yarn supplying bobbin guide 25 in which the divided sections 37, 38 are mutually close, and the yarn supplying bobbin B is then installed on a peg of the tray T in such a manner as to stand perpendicularly, as shown in FIG. 6. After this installation, the divided sections 37, 38 of the yarn supplying bobbin guide 25 recede to the receding position so as to be mutually separated, so that the yarn supplying bobbin B is not hindered from movement.

Subsequently, the tray T with the yarn supplying bobbin B installed thereon is delivered from the yarn-supplying-bobbin installing position D to the yarn cutting position E by the oscillating lever 23*b* of the tray delivery mechanism 23, where the tray T is then stopped. The yarn Y on the yarn supplying bobbin B having its yarn end Ya held by the yarn end holder 18 is moved to a substantially vertical state as the yarn handling lever 24*a* oscillates, and the yarn Y is subsequently cut by the cutter 24*b*. The cut yarn Y is sucked into a hollow opening in the yarn supplying bobbin B by means of the suction device 40.

When the oscillating lever 23*b* of the tray delivery mechanism 23 returns and oscillates in an arrow G direction, the tray T supporting the yarn supplying bobbin B with the cut yarn Y is pushed to the feeding passage 3, as shown in FIG. 4. The tray T with the yarn supplying bobbin installed thereon, which has been pushed to the feeding passage 3, is supplied to a winding unit U requiring a yarn supplying bobbin.

In the automatic winder 11 according to this embodiment, the winding unit U and the yarn-supplying-bobbin feeding device 12 can be removed from the support pipe 13 and the fixing frame 14 each acting as a mounting member and are compatible with them in terms of mounting dimensions, so that the yarn-supplying-bobbin feeding device 12 can be replaced for the winding unit U in an arbitrary installation space S. For example, in FIGS. 1 and 3, the leftmost winding unit U can be replaced with the yarn-supplying-bobbin feeding device 12 to increase the number of yarn-supplying-bobbin feeding devices 12 or the illustrated yarn-supplying-bobbin feeding devices 12 can be replaced with winding units U to reduce the number of yarn-supplying-bobbin feeding devices 12. The yarn-supplying-bobbin feeding device 12 can be installed by changing a program for the winding units U. Thus, the automatic winder 11 can increase the number of yarn types processed, by a value equal to the number of yarn-supplying-bobbin feeding devices 12. The automatic winder 11 can be used with the yarn-supplying-bobbin automatic feeding device CBF so that the yarn-supplying-bobbin feeding device 12 is used for a yarn type for small-scale production whereas the yarn-supplying-bobbin automatic feeding device CBF is used for a yarn type for mass production, thereby improving the operation rate of the winding units U.

Moreover, a position where the yarn-supplying-bobbin feeding device 12 is installed can be arbitrarily selected. It is thus easy to, for example, increase the number of winding units U for a yarn type V while reducing the number of winding units U for a yarn type W.

Additionally, the automatic winder 11 is essentially based on the tray method and can thus save labor compared to the magazine method.

Moreover, the yarn-supplying-bobbin feeding device 12 is simpler than the yarn-supplying-bobbin automatic feeding device CBF and can be installed more easily than it.

Furthermore, since the yarn-supplying-bobbin feeding device 12 cuts off the ejection passage 2 and the feeding passage 3, it mutually separates groups of winding units to preclude the tray from moving among the separated groups of winding units, thereby avoiding mixing different yarn.

In the automatic winder according to the present invention, the number of yarn-supplying-bobbin feeding devices can be increased or reduced easily by installing the yarn-supplying-bobbin feeding device that is compatible with the winding unit in terms of mounting dimensions, in an arbitrary installation space based on a production plan. Consequently, for example, the number of yarn types handled by a single automatic winder can be changed easily.

In the automatic winder according to the present invention, since the cut-off member is provided and the yarn-supplying-bobbin feeding device can mutually separate the plurality of winding units, each bobbin conveying medium is circled through the group of individual separated winding units without moving out from the group. This configuration, for example, prevents different types of yarns from being wound by a single winding unit.

The automatic winder according to the present invention can receive the bobbin separate from the tray, since the bobbin removing device is provided, thereby improving operational efficiency.

In the automatic winder according to the present invention, since the magazine, the yarn end holder, the yarn supplying bobbin picker, the yarn supplying bobbin guide and the yarn cutter are provided, the compact configuration can be used to install the yarn supplying bobbin on the bobbin conveying medium and to find the yarn end of the yarn supplying bobbin, thereby improving operational efficiency.

What is claimed is:

1. An automatic winder comprising an ejection passage formed therein for ejecting a bobbin conveying medium with a bobbin placed thereon and a feeding passage formed therein for feeding the bobbin conveying medium, the automatic winder having a plurality of installation spaces, each arranged for installation therein of a single winding unit, the winder being characterized in that a yam-supplying-bobbin feeding device is installed in an arbitrary installation space while the winding unit is installed in each of the other installation spaces so that the bobbin conveying medium ejected from the winding unit is received by said yam-supplying-bobbin feeding device via said ejection passage while the bobbin conveying medium is fed from the yarn-supplying-bobbin feeding device to said winding unit via said feeding passage.

2. Automatic winder according to claim 1, characterized in that said yarn-supplying-bobbin feeding device comprises a cut-off member for cutting off each of said ejection passage and said feeding passage and a linking passage for connecting a downstream end of the cut-off ejection passage and an upstream end of the cut-off feeding passage together.

3. Automatic winder according to claim 2, characterized in that said yarn-supplying-bobbin feeding device comprises a bobbin removing device for removing said bobbin from said bobbin conveying medium ejected from said winding unit.

4. Automatic winder according to claim 2 or claim 3, characterized in that said yarn-supplying bobbin feeding device comprises a plurality of yarn supplying bobbins, a magazine in which the plurality of yarn supplying bobbins are stored, a yarn end holder for holding yarn ends of the yarn supplying bobbins stored in the magazine, a yarn supplying bobbin picker for picking up the yarn supplying bobbins from the magazine one at a time, a yarn supplying bobbin guide for dropping the yarn supplying bobbin picked up from the magazine, onto said linking passage in a manner such that the yarn supplying bobbin stands perpendicularly, and a yarn cutter disposed between a position at which the yarn supplying bobbin is dropped and said yarn end holder.

* * * * *